United States Patent [19]

Durgin et al.

[11] 4,366,696

[45] Jan. 4, 1983

[54] NESTABLE CAN METHOD OF MANUFACTURE

[75] Inventors: Ronald A. Durgin, Pleasanton; Florentino Q. Apelin, Daly City; Gordon D. Henderson, Alemada, all of Calif.

[73] Assignee: Western Can Company, San Francisco, Calif.

[21] Appl. No.: 219,937

[22] Filed: Dec. 24, 1980

[51] Int. Cl.[3] ..... B21D 22/00

[52] U.S. Cl. ..... 72/339; 72/348

[58] Field of Search ..... 72/58, 348, 347, 339

[56] References Cited

U.S. PATENT DOCUMENTS

| | | | |
|---|---|---|---|
| 1,987,101 | 1/1935 | Fabrice | 72/348 X |
| 2,108,512 | 2/1938 | Reichenbach | 72/348 |
| 3,029,507 | 4/1962 | Gaggini | 72/348 X |
| 3,732,835 | 5/1973 | Long | 72/348 |
| 3,811,393 | 5/1974 | Close | 72/348 |

OTHER PUBLICATIONS

Metals Handbook–1948 edition, p. 774.

*Primary Examiner*—Leon Gilden

*Attorney, Agent, or Firm*—Ernest M. Anderson

[57] ABSTRACT

A nestable can and method of manufacture is described wherein a blank cut from sheet metal stock is drawn into a tapered die with a tapered drawhorn to form a first stage cup having a bottom, a tapered cylindrical sidewall and a peripheral flange. Care is taken to avoid coining of the sidewall in the first stage of manufacture. The partially formed can is then reformed by expanding the sidewall while maintaining its taper, thereby removing wrinkles and forming a second stage cup having smooth interior and exterior sidewall surfaces.

The nestable quality of the cup is dependent upon a novel profile created while reforming the first stage cup. In that operation the upper end of the cup is reshaped to form an upper rim that is offset from a tapered sidewall and having convex contact surfaces that support one cup within another. The location of the contact surfaces is such that adjacent sidewalls of two nested cups are spaced apart by at least 0.0015 inch, the peripheral rims being vertically spaced by at least 0.140 inch to facilitate cup separation.

10 Claims, 5 Drawing Figures

NESTABLE CAN METHOD OF MANUFACTURE

SUMMARY OF THE INVENTION

A method is taught for forming a tapered nestable can from sheet metal stock. Not unlike prior art methods, a circular blank is initially cut from sheet metal stock and then drawn into a tapered die with a tapered drawhorn. This forms a first stage cup having a bottom, a cylindrical sidewall and a peripheral flange. Unlike the prior art methods, however, the sidewall of the first stage cup is initially drawn and tapered without "coining" and, therefore, small wrinkles or creases are formed. The first stage cup is thereafter reformed by expanding the diameter of the sidewall while maintaining substantially the same taper, thereby removing wrinkles and forming a second stage cup having smooth interior and exterior sidewall surfaces.

It is a principal object of the present invention to provide a tapered nestable can and method for manufacture from precoated sheet metal stock, a can which also possesses relatively smooth inner and outer sidewall surfaces.

A further object is to provide a can of the kind described, the tapered sidewall thereof being formed at an angle of approximately 87° relative to the bottom, allowing the can to receive and be filled with a right cylindrical plug of food.

It is a still further object of the invention to provide a can of the kind described and having a profile or configuration allowing such cups to be closely nested in predetermined spaced relationship without lockups therebetween.

Another object is to provide a can and method for manufacture of the kind described which preserves and protects surfaces of the can during its manufacture, allowing the can to be formed from precoated sheet metal stock.

Other objects of this invention will become apparent in view of the following detailed description and the accompanying drawings.

Figure 1:
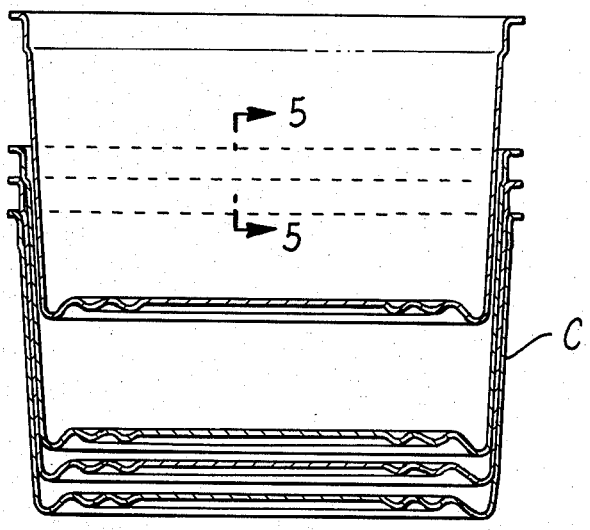
Figure 2:
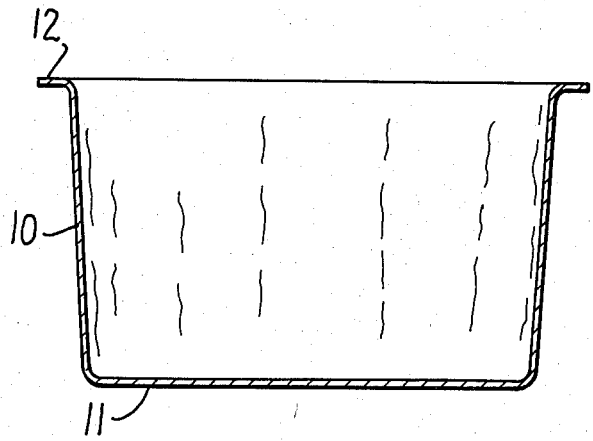
Figure 3:
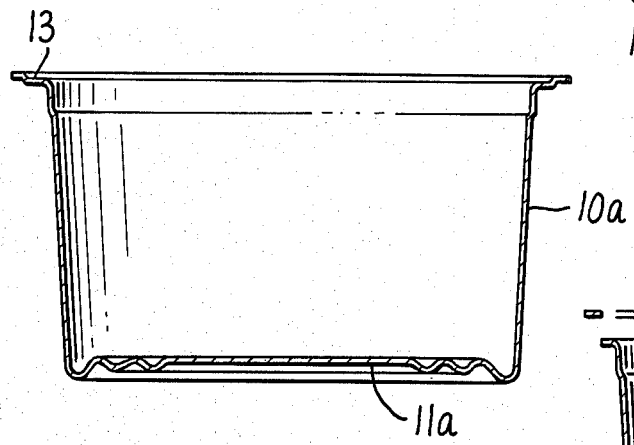
Figure 4:
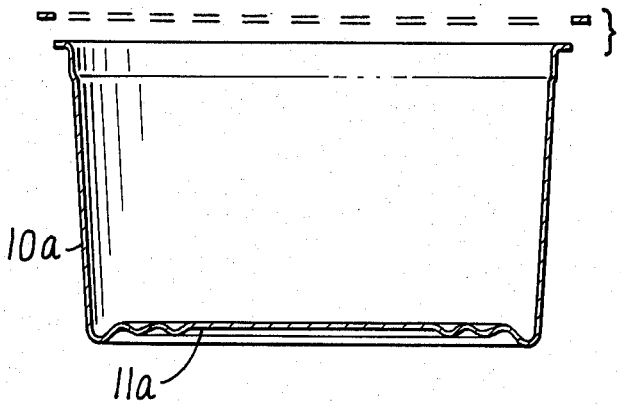
Figure 5:
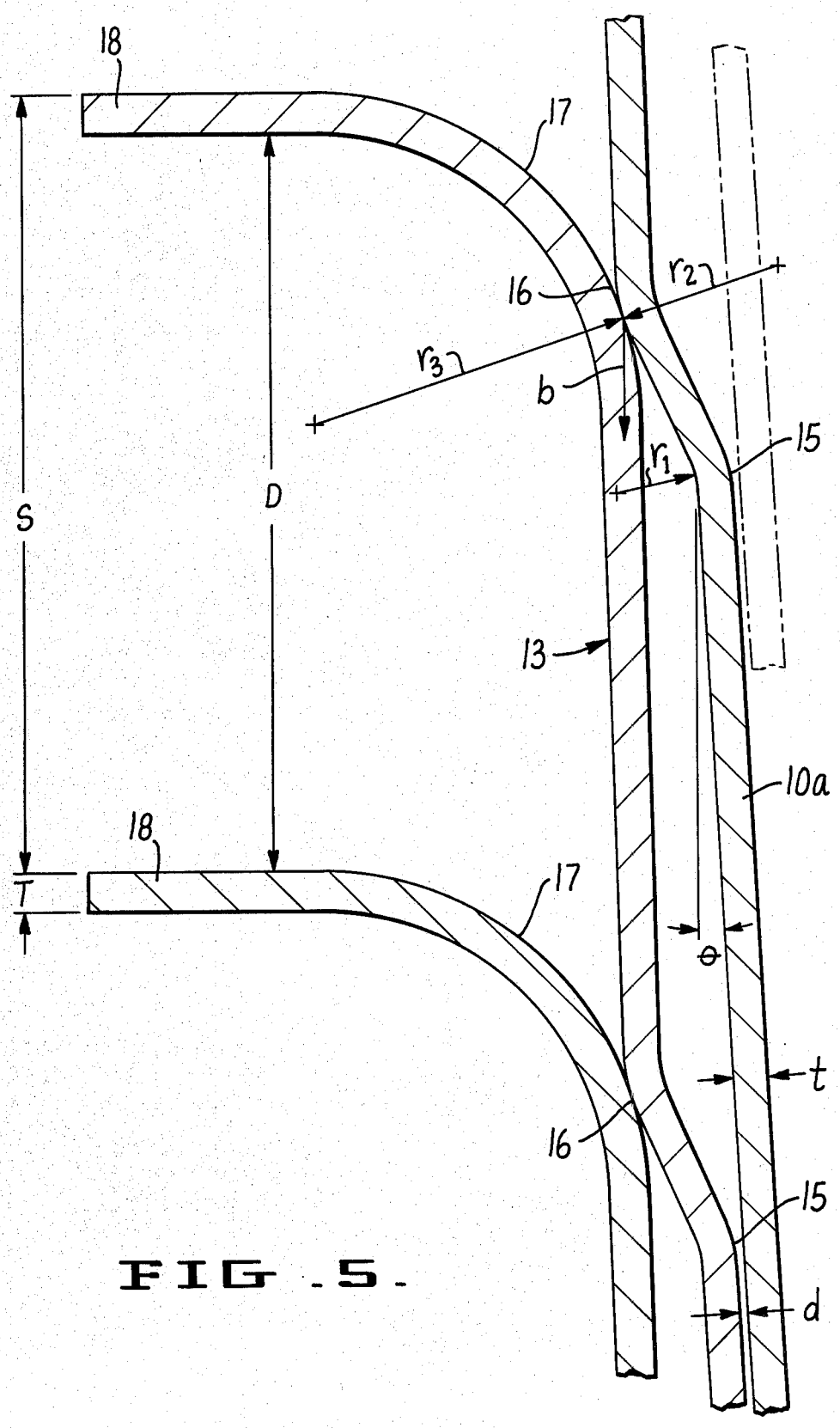

In the drawings forming a part of this application and in which like parts are identified by like reference numerals throughout the same, FIG. 1 is a vertical center section of a plurality of nestable cans made in accordance with this invention;

FIGS. 2, 3 and 4 illustrate sequential stages of manufacturing each can; and FIG. 5 is an enlarged vertical section taken on the lines 5—5 of FIG. 1 showing structural relationships of and between cans that are nested.

This invention is particularly useful in providing a container of high integrity which is suitable for packaging food products, such as fish. One element of its utility is in providing a nestable can that may be shipped to the user in packages of high density.

Prior art can constructions currently in use most commonly provide a three-piece soldered can comprising a cylindrical can body and a pair of ends. The can body is first made in a right cylindrical configuration but then collapsed to increase shipping density. Upon arrival at the packers' plant the can body is reformed to a round configuration and one end is seamed on prior to filling. The operation of collapsing the can and reforming them at the point of use is deleterious, both to the can body seams and to the coating which is conventionally applied during or prior to manufacture.

It has been recognized that a two-piece can construction comprising a cup having an integral sidewall and bottom is a preferred construction since it solves problems of seam leakage and coating removal. However, conventional two-piece cans have not been made which can be economically shipped and/or reassembled at the packers' plant, although it is apparent that a tapered nestable can may be made to increase shipping density.

The production of an acceptable two-piece can has proven difficult using conventional drawing methods, except for very shallow cups, since the cans must be free of wrinkles and bulges and the coating must be maintained when using precoated stock. It is believed that the can industry generally considers the manufacture of tapered two-piece containers to be difficult to the point of impractical.

Notwithstanding, it is to be recognized that two-piece cans comprised of a one-piece cup and closure lid are known, and such cans have been made with nestable tapered sidewalls, such as taught in U.S. Pat. No. 3,248,003. It is to be further understood that the manufacture of nestable plastic containers and cups is well-known as exemplified by the teaching contained in U.S. Pat. Nos. 2,879,917; 3,091,360; and 3,139,213. The present invention, however, differs fron earlier teachings both in the method of manufacture and in providing a cup configuration which can be internested, stacked and subsequently separated for process filling with conventional machines.

Referring to FIG. 1 of the drawings, there is shown a plurality of internested cups C, each cup being formed in essentially three stages as contemplated by this invention. FIGS. 2–4 illustrate the three stages of manufacture. First, as shown in FIG. 2 a circular blank (cut from precoated sheet metal stock) is drawn into a tapered die with a tapered drawhorn, forming a first stage cup having a bottom 10, a tapered cylindrical sidewall 11, and a peripheral flange 12. The preferred embodiment of can is made with a sidewall that tapers upwardly from a bottom plane at an angle of 87° (3° taper relative to the vertical).

The first stage cup is formed without "coining" the sidewall. (The term "coining" as used herein is defined as the stamping or extrusion of metal to change its shape and thinness). To avoid "coining" during the manufacture of the first stage cup a spacing is maintained between surfaces of the die and drawhorn, and that spacing should be equal to at least two metal thicknesses of the sheet metal stock from which the blank is formed. For example, 75# sheet steel stock of 0.0083 inch thick is a suitable material, and at least twice that thickness (0.0166 inch) should be used as clearance when such material is used. As a consequence the first stage cup will possess longitudinal wrinkles in the sidewall. Those wrinkles are then removed in a reforming process wherein the first stage cup is expanded or cylindrically enlarged using a tapered drawhorn of increased size, but of substantially the same taper as that used in the initial drawing operation. In the reforming process the sidewall of the first stage cup is diametrically enlarged, but the finished diameter of the sidewall is less than five percent (5%) greater than the diameter of the sidewall of the first stage cup. An increase of between two and three percent (2–3%) has been found to produce smooth sidewall surfaces while preserving the integrity of coatings applied to precoated metal stock. Expanding the diameter size above five percent (5%) tends to cause metal fractures and serious impairment of the coating.

FIG. 3 illustrates the preferred shape of the second stage cup having a sidewall 10*a*, a bottom 11*a* and an upper rim 13. In reforming, both the upper end and bottom wall of the first stage cup is reshaped and profiled. It will be noted that rim 13 is laterally and outwardly offset from the reformed sidewall 10*a*, and the bottom is profiled to increase its strength. Thereafter, the flange portion of the rim is trimmed or cut to a precise diameter, as shown in FIG. 4, to form the finished cup.

FIG. 5 illustrates details of a rim profile which provides both the feature of nesting as well as selected spacing of nested cans. More particularly, rim 13 is formed with first, second and third curvatures, the first curvature being formed on a radius $r_1$ and defining a first interior convex surface 15, the second curvature being formed on a radius $r_2$ and defining an exterior convex surface 16, and the third curvature being formed on a radius $r_3$ and defining a second interior convex surface 17. The first curvature projects the rim radially outward and offset from tapered sidewall 10*a*; the second curvature directs a section of the rim vertically upward to support an inner cup; and the third curvature connects to a radial flange 18. The radii of the three convex surfaces are selected and located one to another such that the finished cups nest within another, the exterior convex surface 16 of an inner cup resting upon the second interior convex surface 17 of an outer cup and providing a spacing between adjacent sidewalls (shown by the letter "d") which is at least 0.0015 inch. The spacing between sidewalls is critical in that a spacing of sidewalls closer than 0.0015 may present problems in the separation of nested cups. Closer spacings of sidewalls tend to result in vacuum type lock-ups and a separation of such cups may cause scuffing of the coated can surfaces.

It is also to be noted that the radius $r_2$ forming convex surface 16 is substantially less than the radius $r_3$ forming convex surface 17, and contact between nested cups occurs at a point of cotangency whose vertical projected line image "b" is within the concave profile of convex surface 17. Thus, once contact is made between surfaces of nested cups, the inner cup is supported on a circular ring of point contacts within the outer cup. Separation of cups is thereby inhanced by virtue of the small area of surface contact and smoothness of surfaces.

It will be apparent that the packing density of nested cups increases in direct proportion to the flange spacing "D" between cups. This follows since the cup diameter and height are fixed. Therefore, the closer the flange spacing, the more dense the pack. Although a minimum flange spacing has not been established, it has been determined that a flange spacing of 0.140 to 0.190 inch works well with standard processing equipment.

It may be noted that a geometric and dimensional relationship exists in forming rim 13. The flange spacing D is a linear distance function of flange displacement distance S (a vertical distance from the surface of one cup flange 18 to the corresponding surface of a nested cup flange 18) and the flange thickness T. ($D=S-T$). But displacement distance S is also a function of the clearance spacing d between sidewalls, the maximum thickness t of the sidewalls and the angle of sidewall taper $\theta$. This latter relationship may be expressed by the formula $S=(d+t)/\tan\theta$, and that formula may be used to determine or select flange spacing. As an example, and assuming the following values by engineering design, if $d=0.0016''$, $t=0.0083''$, and $\theta=3°$, then $S=0.1875''$. If engineering design also suggests a flange thickness T of 0.0105", then flange spacing D will be 0.177".

The distance S, it will be evident, also describes or is equal to the axial distance between the convex surfaces 16 and 17 at points of contact with nested cups. Thus, once distance S is selected the locations of the convex surfaces (and the location of the circular ring of contacts) become fixed; and the profile of rim 13 is then functionally determined.

Although a preferred embodiment of the invention has been illustrated and described, various modifications and changes may be resorted to without departing from the spirit of the invention or the scope of the appended claims, and each of such modifications and changes is contemplated.

What is claimed is:

1. A method for forming a tapered nestable can from sheet metal stock comprising the steps:

cutting a blank from sheet metal stock, and drawing the blank into a tapered die with a tapered drawhorn while forming a first stage cup having a bottom, a tapered cylindrical sidewall and a peripheral flange, said blank being drawn without coining said sidewall and allowing wrinkles to form therein; and reforming the first stage cup by expanding the diameter of the tapered cylindrical sidewall to remove the wrinkles while maintaining substantially the same taper, the diameter of said sidewall after expanding being less than five percent (5%) greater than the diameter of the sidewall of the first stage cup.

2. The method of claim 1, said step of drawing the blank being done while maintaining a sidewall forming space between the die and drawhorn equal to at least two metal thicknesses of the blank from which the cup is made.

3. The method of claim 1, the tapered sidewall of the cup being formed by drawing and expanding the blank at an angle of approximately 87° relative to the bottom of the cup.

4. The method of claim 1, and then trimming the offset upper rim to a selected diameter for seaming with a closure lid.

5. The method of claim 1, the step of reshaping the upper end of the cup to form an offset upper rim having a profile including first, second and third curvatures, the first curvature forming a first interior convex surface, the second curvature forming an exterior convex surface and the third curvature forming a second interior convex surface, the first curvature projecting said rim radially outward and offset from the tapered sidewall, said second curvature directing a section of said rim convergently relative to an imaginary extension of the tapered sidewall, and said third curvature forming an outwardly curved lip, said convex surfaces being of a length and located that one finished cup nests within another, the exterior convex surface of the inner cup contacting the second interior convex surface of the outer cup when said cups are nested and providing a spacing between adjacent sidewalls of at least 0.0015 inch.

6. The method of claim 5, the axial length of the offset upper rim from the points of contact between nested cups to the end of the outwardly curved lip providing a flange spacing of at least 0.140 inches between nested cups.

7. The method of claim 5, the tapered sidewall being formed by drawing and expanding the blank at an angle of approximately 87° relative to the bottom of the cup.

8. The method of claim 5, and then trimming the offset upper rim to a selected diameter for seaming with a closure lid.

9. The method of claim 5, the second curvature being formed on a radius substantially less than the radius of the third curvature, contact between nested cups being made on a circular ring of point contacts, the vertically projected line image of each point contact being within the concave profile of the second interior convex surface.

10. The method of claim 1, the diameter of said fully drawn and expanded sidewall being two to three percent (2–3%) greater than the diameter of the first stage cup.

* * * * *